US009539707B2

(12) United States Patent
Huang

(10) Patent No.: US 9,539,707 B2
(45) Date of Patent: Jan. 10, 2017

(54) ADJUSTABLE WRENCH WITH STRENGTH ENHANCING STRUCTURAL DESIGN

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 64 days.

(21) Appl. No.: 14/165,663

(22) Filed: Jan. 28, 2014

(65) Prior Publication Data

US 2015/0190905 A1 Jul. 9, 2015

(30) Foreign Application Priority Data

Jan. 6, 2014 (TW) ..... 103100338 A

(51) Int. Cl.

| | |
|---|---|
| ***B25B 13/16*** | (2006.01) |
| ***B25B 13/14*** | (2006.01) |
| ***B25B 13/12*** | (2006.01) |
| ***B25B 23/00*** | (2006.01) |
| ***B25B 23/16*** | (2006.01) |

(52) U.S. Cl.

CPC ..... *B25B 13/14* (2013.01); *B25B 13/12* (2013.01); *B25B 23/0007* (2013.01); *B25B 23/16* (2013.01)

(58) Field of Classification Search

CPC ..... B25B 13/14; B25B 13/20; B25B 13/12; B25B 13/10

USPC ..... 81/165, 129, 129.5, 155, 166, 167

See application file for complete search history.

(56) References Cited

U.S. PATENT DOCUMENTS

| | | | | |
|---|---|---|---|---|
| 1,444,793 | A | 2/1923 | Keller | |
| 1,975,908 | A | 10/1934 | Swanson | |
| 2,708,856 | A * | 5/1955 | Brynge | 81/165 |
| 3,546,982 | A | 12/1970 | Kohler et al. | |
| 4,344,339 | A | 8/1982 | Penner | |
| 4,449,431 | A * | 5/1984 | Brunosson | 81/165 |
| 5,331,868 | A * | 7/1994 | Elmore | B25B 13/14 81/145 |
| 6,382,056 | B1 * | 5/2002 | Wu | B25B 13/14 81/165 |

(Continued)

FOREIGN PATENT DOCUMENTS

| | | | |
|---|---|---|---|
| CN | 201895281 | U | 7/2011 |
| DE | 358684 | C | 9/1922 |

(Continued)

*Primary Examiner* — Hadi Shakeri
*Assistant Examiner* — Danny Hong
(74) *Attorney, Agent, or Firm* — Alan D. Kamrath; Kamrath IP Lawfirm, P.A.

(57) ABSTRACT

An adjustable wrench with strength enhancing structural design includes a body including a grip end and a driving head. The driving head includes a fixed jaw and a movable jaw. The movable jaw engages and is operably movable in a groove. The groove includes two lateral walls facing oppositely and spacing from each other. Each of the two lateral walls includes a first surface and a second surface. The first surfaces of the two lateral walls face oppositely and are separated by a space. The first and second surfaces of each of the two lateral walls have a common edge and an included angle less than 90 degrees. The movable jaw includes two slopped surfaces corresponding to and abutting against the second surfaces of the two lateral walls.

14 Claims, 9 Drawing Sheets

(56) References Cited

U.S. PATENT DOCUMENTS

| | | | | |
|---|---|---|---|---|
| 6,470,773 | B1 * | 10/2002 | Wu | B25B 13/12 81/165 |
| 6,928,905 | B1 * | 8/2005 | Hsien | B25B 13/14 81/129 |
| 7,240,591 | B2 * | 7/2007 | Hsien | B25B 13/14 81/165 |
| 8,191,446 | B1 | 6/2012 | Sherri | |
| 2002/0038583 | A1 | 4/2002 | Hu | |
| 2004/0035262 | A1 | 2/2004 | Hsien | |
| 2005/0204872 | A1 * | 9/2005 | Hsien | 81/165 |
| 2006/0174732 | A1 | 8/2006 | Chen | |
| 2009/0193939 | A1 * | 8/2009 | Chiu et al. | 81/60 |
| 2013/0145907 | A1 | 6/2013 | Takenaka | |

FOREIGN PATENT DOCUMENTS

| | | | |
|---|---|---|---|
| EP | 1249313 | A1 | 10/2002 |
| FR | 916961 | A | 12/1946 |
| FR | 1232509 | A | 10/1960 |
| TW | 308925 | | 6/1997 |
| TW | M332002 | U | 5/2008 |
| TW | I307301 | B | 3/2009 |
| TW | I328492 | B | 8/2010 |
| TW | I365794 | | 6/2012 |
| WO | WO9401247 | A2 | 1/1994 |

* cited by examiner

ADJUSTABLE WRENCH WITH STRENGTH ENHANCING STRUCTURAL DESIGN

BACKGROUND OF THE INVENTION

1. Field of the Invention

The present invention relates to an adjustable wrench and, in particular, to an adjustable wrench with a strength enhancing structural design.

2. Description of the Related Art

Generally, an adjustable wrench has two jaws for engaging an object to be driven in between. The two jaws include one being a fixed jaw and the other being a movable jaw, which is operably movable relative to the fixed jaw at different relative positions for various sizes of objects. However, it is found that the movable jaw gets easier to move with respect to the fixed jaw inadvertently. As a result, the jaws are liable to slip and round an object to be driven.

The present invention is, therefore, intended to obviate or at least alleviate the problems encountered in the prior art.

SUMMARY OF THE INVENTION

According to the present invention, an adjustable wrench with a strength enhancing structural design includes a body including a grip end a user grasps when operating the adjustable wrench at a first end thereof and a driving head at a second end thereof. The driving head includes a fixed jaw and a movable jaw for clamping an object to be driven by the adjustable wrench in between. The movable jaw engages and is operably movable in a groove. The groove includes two lateral walls facing oppositely and spaced from each other. Each of the two lateral walls includes a first surface and a second surface. The first surfaces of the two lateral walls face oppositely and are separated by a space. The first and second surfaces of each of the two lateral walls have a common edge and a first included angle less than 90 degrees. The movable jaw includes two slopped surfaces corresponding to and abutting against the second surfaces of the two lateral walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
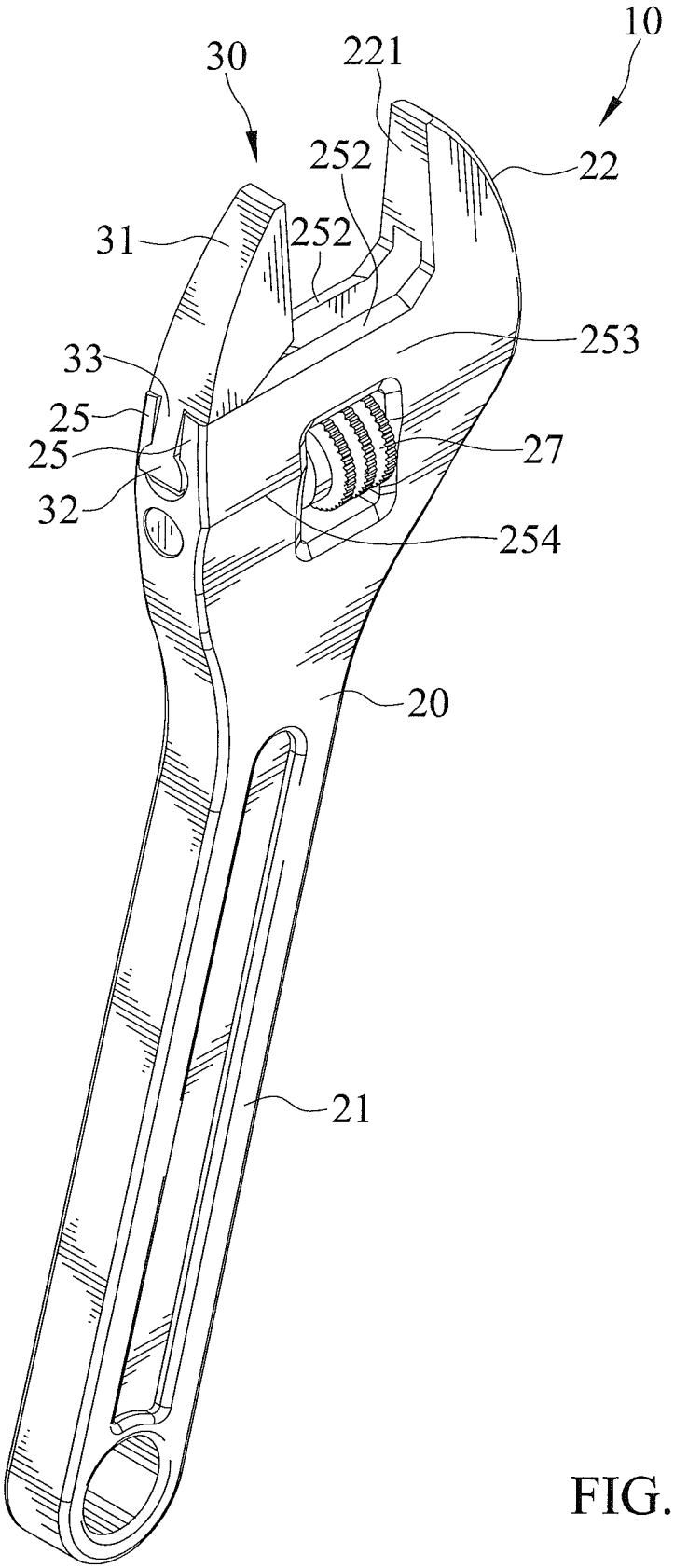
FIG. 1 is a perspective view of an adjustable wrench with a strength enhancing structural design in accordance with a first embodiment of the present invention.
Figure 2:
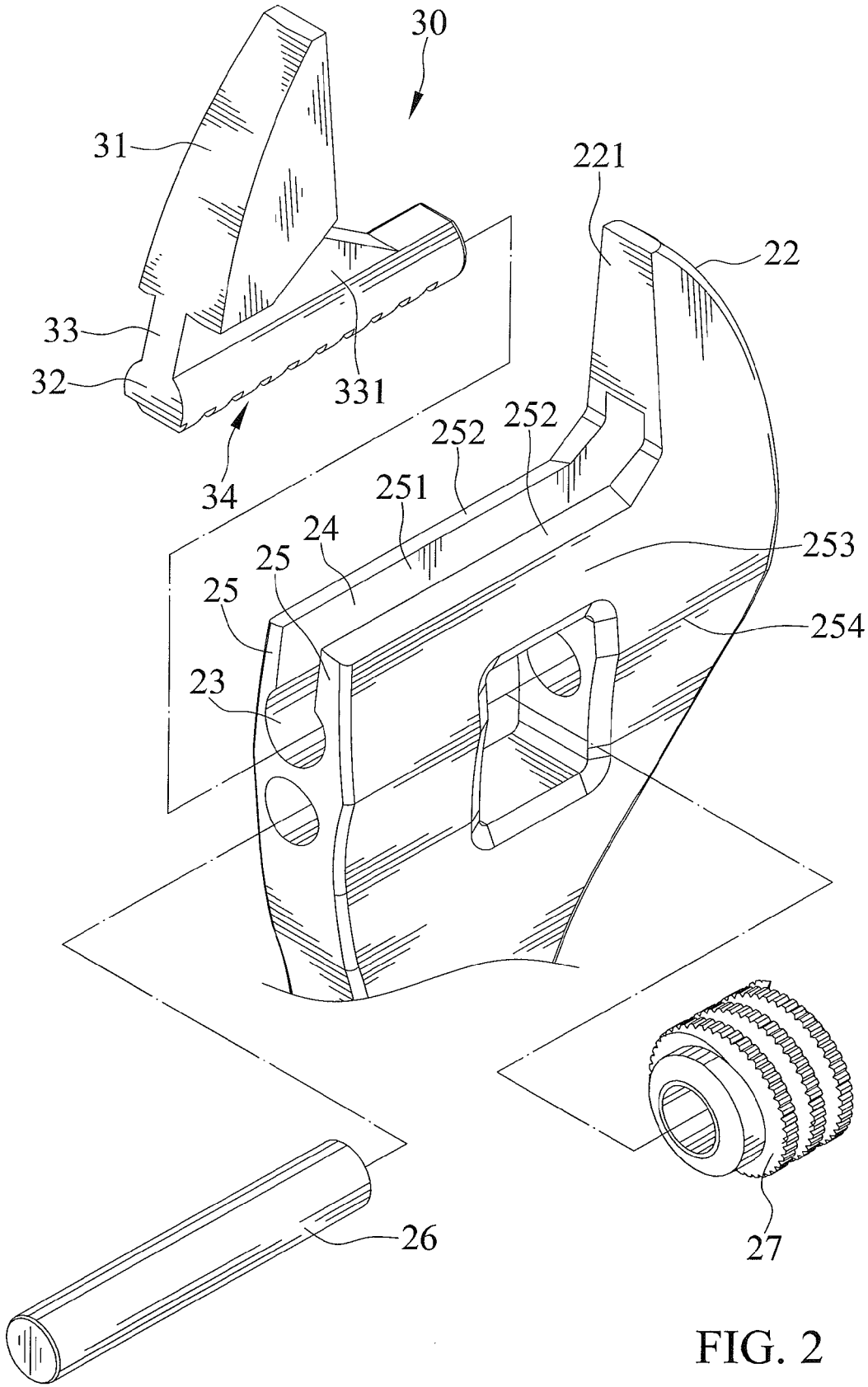
FIG. 2 is an exploded perspective view of the adjustable wrench of FIG. 1.
Figure 3:
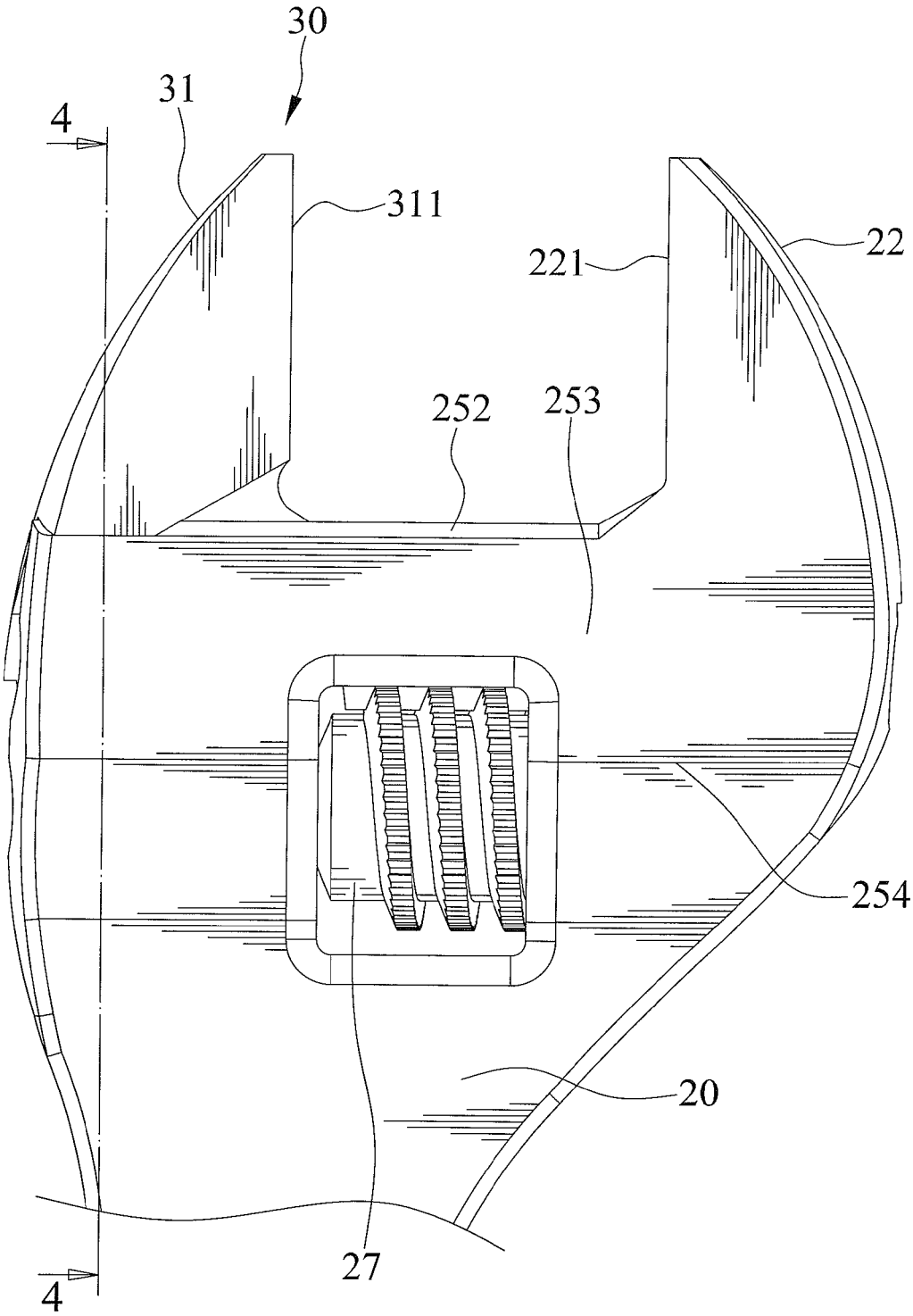
FIG. 3 is a partial view of the adjustable wrench of FIG. 1 in side elevation.
Figure 4:
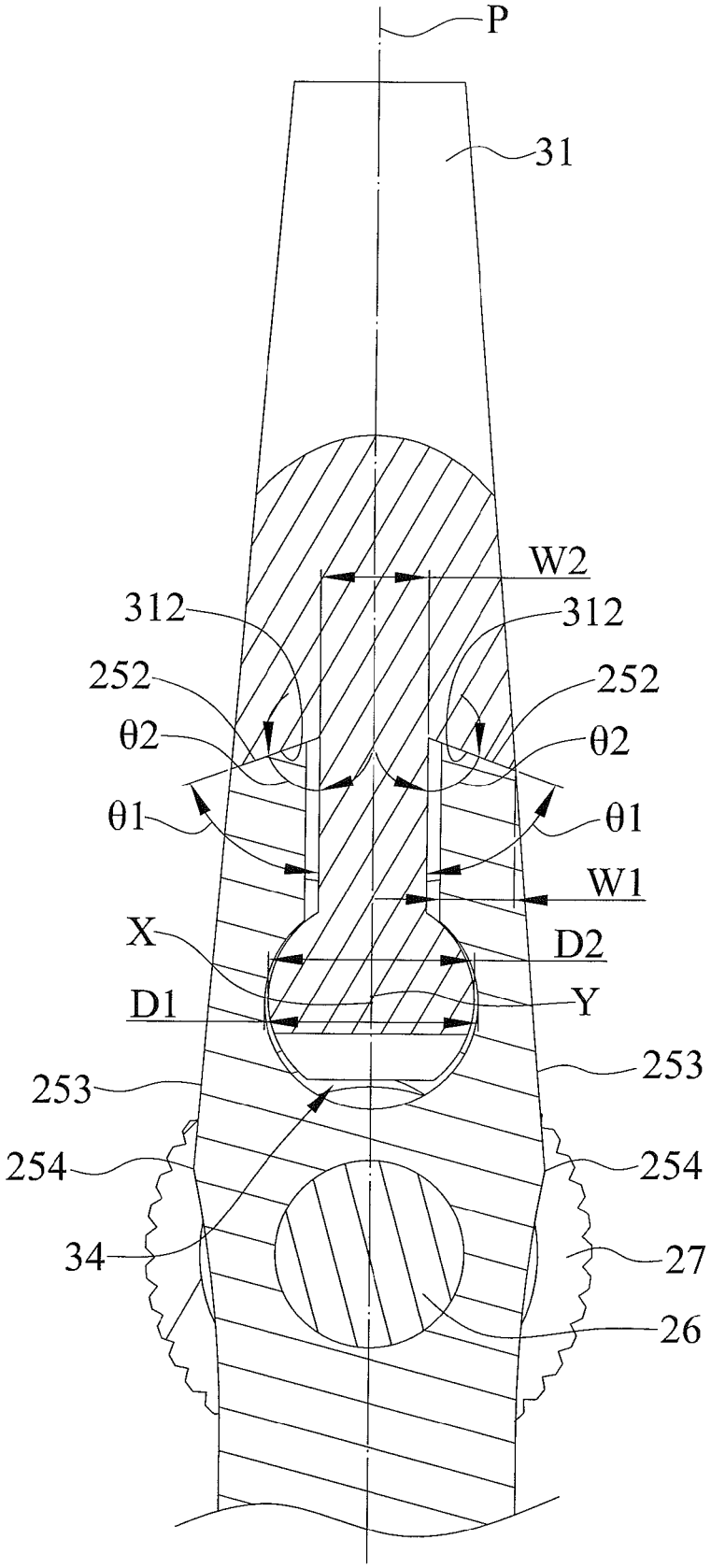
FIG. 4 is a cross-sectional view taken along line 4-4 of FIG. 3.
Figure 5:
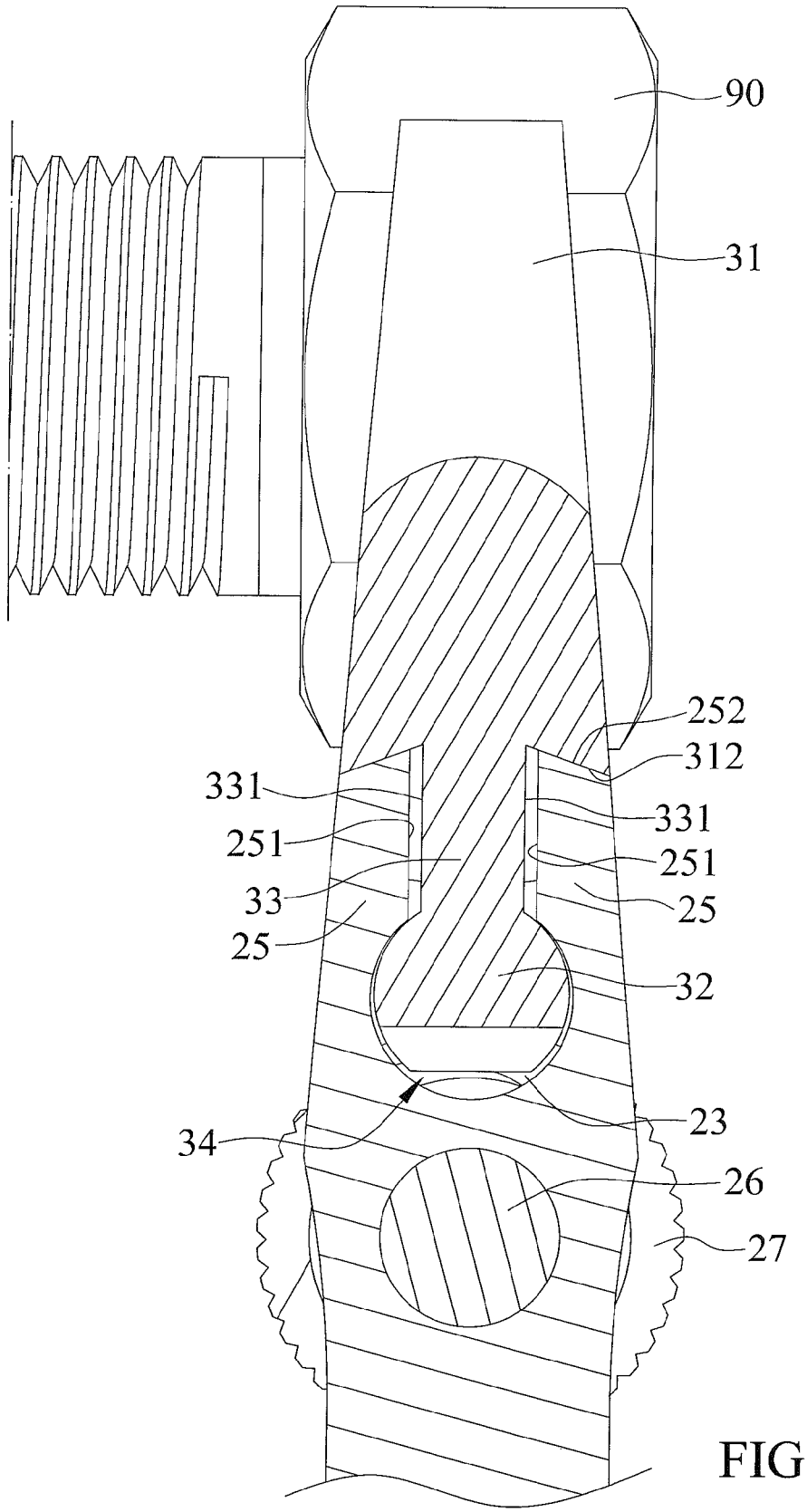
FIG. 5 is a partial, cross-sectional view showing the adjustable wrench of FIG. 1 engaging with a bolt.
Figure 6:
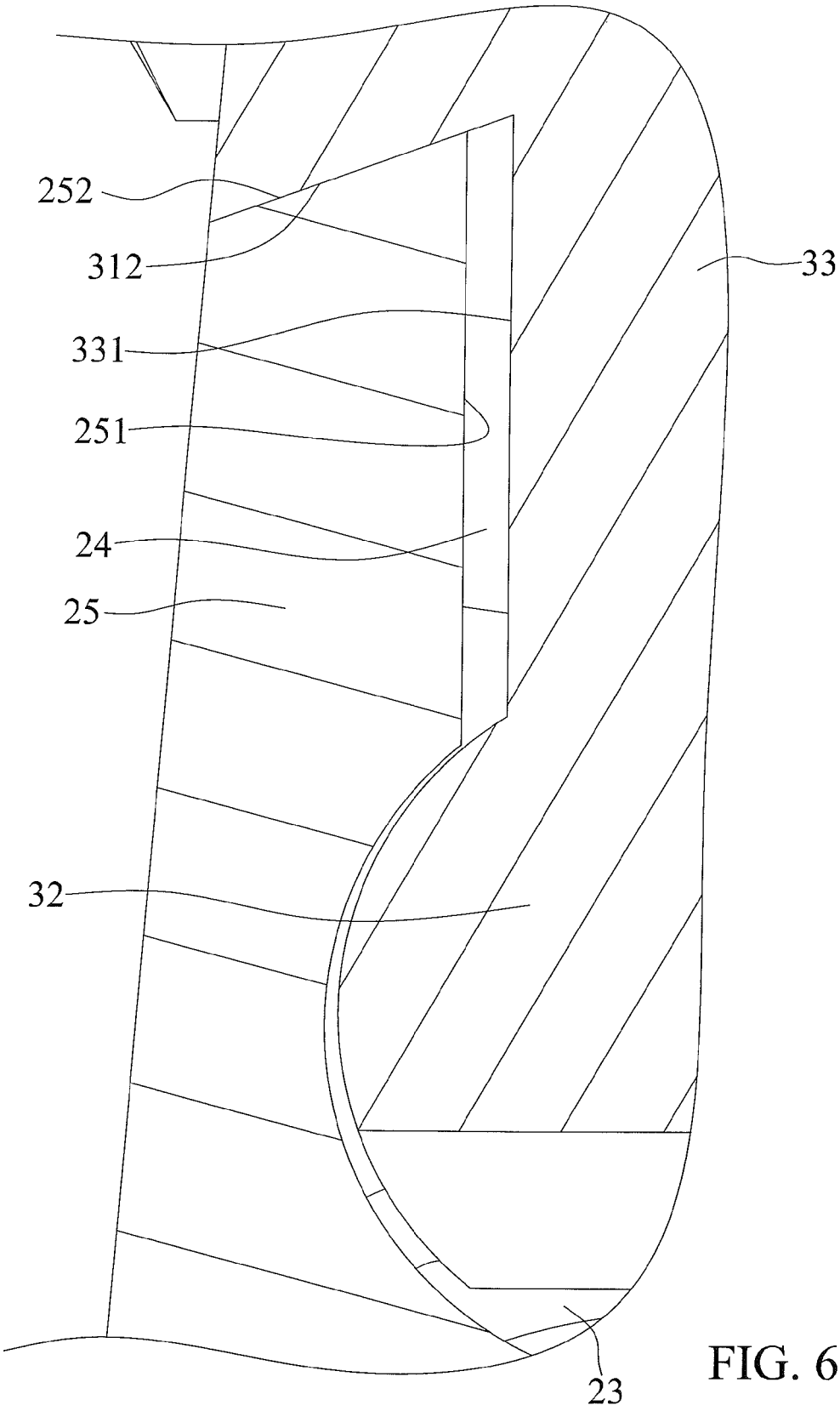
FIG. 6 is an enlarged cross-sectional view of FIG. 5.
Figure 7:
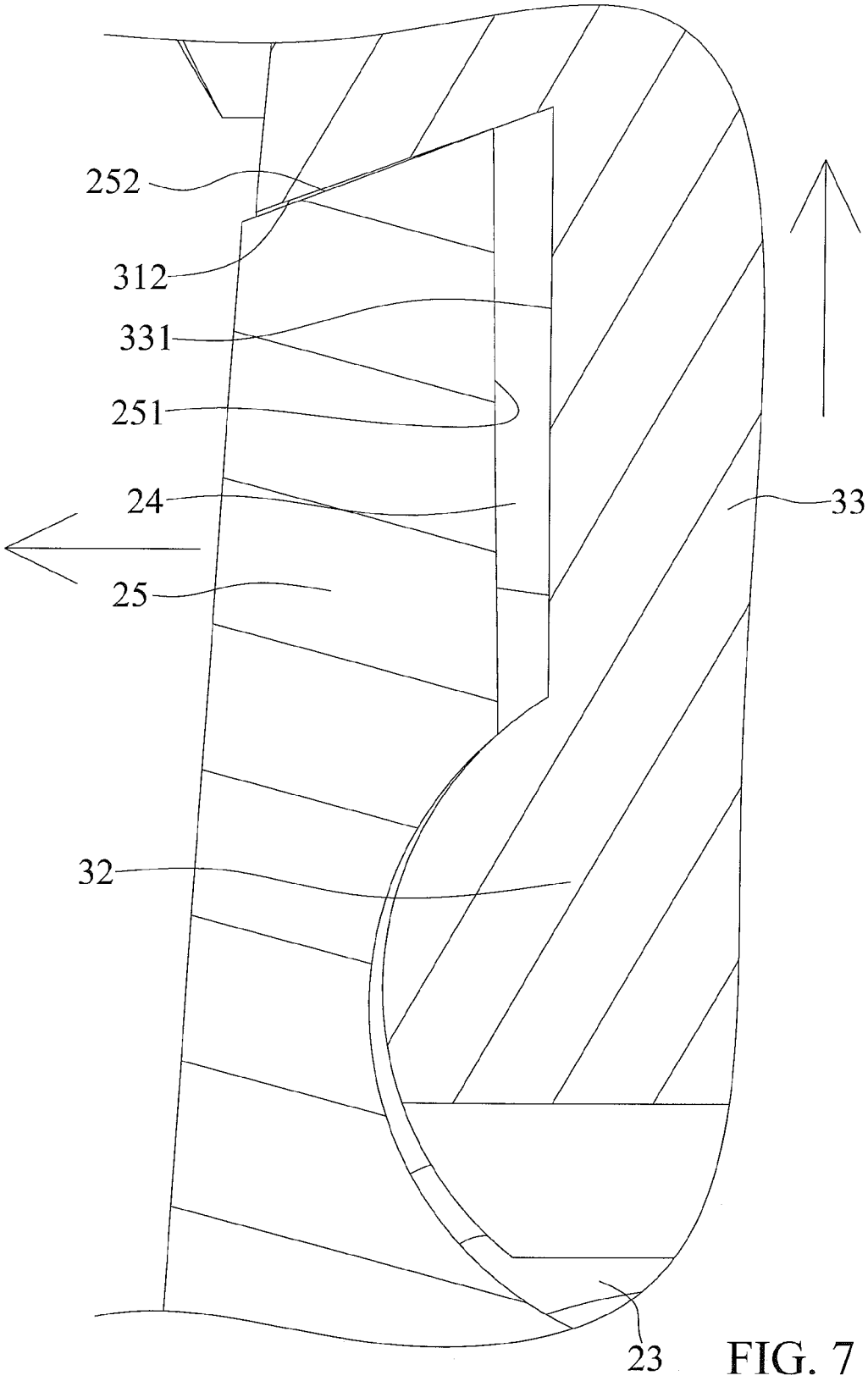
FIG. 7 is a cross-sectional view showing a movable jaw of the adjustable wrench being restrained to prevent inadvertent movement when the bolt is being turned.

FIGS. 1 through 7 show an adjustable wrench 10 with a strength enhancing structural design in accordance with a first embodiment of the present invention. The adjustable wrench 10 includes a body 20 including a grip end 21 a user grasps when operating the adjustable wrench at a first end thereof and a driving head at a second end thereof. The driving head includes a fixed jaw 22 and a movable jaw 30 for clamping an object 90 to be driven by the adjustable wrench 10 in between. The fixed jaw 22 defines a first holding surface 221, and the movable jaw 30 defines a second holding surface 311 facing oppositely and corresponding to the first holding surface 221. The movable jaw 30 includes a toothed section 34 engaging with a worm 27. The worm 27 is mounted and rotatable on a fixing member 26. The movable jaw 30 is moved with respect to the fixed jaw 22 when the worm 27 is operably rotated on the fixing member 26. The movable jaw 30 engages and is operably movable in a groove 23. The groove 23 has a first end adjacent to the fixed jaw 22 and a second end on a lateral side of the adjustable wrench 10. The first and second ends of the groove 23 are opposite axially. The first end of the groove 23 is a closed end. The second end of the groove 23 is an open end and in which an opening is delimited on the lateral side of the adjustable wrench 10. The groove 23 includes two lateral walls 25 facing oppositely and spacing from each other. Each of the two lateral walls 25 includes a first surface 251 and a second surface 252. The first surfaces 251 of the two lateral walls 25 face oppositely and are separated by a space 24. The first and second surfaces 251 and 252 of each of the two lateral walls 25 have a common edge and a first included angle θ1 less than 90 degrees. Preferably, the first included angle θ1 is 70 degrees. Further, an imaginary plane of symmetry P extends between the two lateral walls 25 and through the driving head and the grip end 21. Further, a first width W1 measures the second surface 252 of each of the two lateral walls 25 in a direction perpendicular to the imaginary plane of symmetry P. Further, a second width W2 measures the first extension in a direction perpendicular to the imaginary plane of symmetry P. A ratio of the first width W1 to the second width W2 has a range between 0.5 and 1. Preferably, the ratio of the first width W1 to the second width W2 has a range between 0.7 and 0.89. Preferably, the ratio of the first width W1 to the second width W2 is 0.75. The movable jaw 30 includes a first extension disposed between the two lateral walls 25. The first extension has two opposite lateral sides 331 each facing the first surface 251 of each of the two lateral walls 25. Each of the two lateral sides 331 and the second surface 252 of each of the two lateral walls 25 disposed on the same side of the imaginary plane of symmetry P include a second included angle θ2 having a range between 50 and 90 degrees. In the embodiment, the first and second included angles θ1 and θ2 are equal. The movable jaw 30 includes a second extension received in a receiving area of the groove 23. The groove 23 defines the receiving area below the space 24. Further, a first imaginary line X extends through a center of the receiving area, and the receiving area has a first diameter D1. The first diameter D1 is greater than the second width W2. Further, a second imaginary line Y extends through a center of the second extension, and the second extension has a second diameter D2 less than the first diameter D1. In addition, the first imaginary line X and the second imaginary line Y are at different heights of the adjustable wrench 10. Therefore, the first and second imaginary lines X and Y are not aligned.

The movable jaw 30 includes a holding end 31, a base 32, and a neck 33 extending between the holding end 31 and the base 32. The movable jaw 30 includes the second holding surface 311 extending on the holding end 31 thereof. The holding end 31 is disposed outside the groove 23. The base 32 is disposed in the groove 23. The first extension of the movable jaw 30 disposed between the two lateral walls 25 defines the neck 33. The second extension of the movable jaw 30 disposed in the receiving area defines the base 32.

Furthermore, the adjustable wrench 10 has a reinforced region in each of two opposite sides 253 of the adjustable wrench 10 and forming a ridge 254. Further, an imaginary line extending through a peak of the ridge 254 on each of the two sides 253 is in a direction perpendicular to the imaginary plane of symmetry P. The imaginary line is not interfered with the groove 23. Further, a distance from the peak of the ridge 254 on one of the two sides 253 to the peak of the ridge 254 on another of the two sides 253 is greater than a distance from the second surface 252 of one of the two lateral walls 25 connecting to one of two sides 253 to the second surface 252 of another of the two lateral walls 25 connecting to another of the two sides 253.

When the adjustable wrench 10 is not driving the object 90, the movable jaw 30 has a neutral position in which it includes two sloped surfaces 312 thereof corresponding to and abutting against the second surfaces 252 of the two lateral walls 25. Furthermore, an end of the movable jaw 30 received in the groove 23 is not abutted against the periphery of the groove 23.

When the adjustable wrench 10 is driving the object 90, the two lateral walls 25 will experience elastic deformation, and the movable jaw 30 will experience a reaction force and move relative to the fixed jaw 22 undesirably. However, the adjustable wrench 10 includes the movable jaw 30 including the two sloped surfaces 312 thereof corresponding to and abutting against the second surfaces 252 of the two lateral walls 25. Furthermore, the end of the movable jaw 30 received in the groove 23 abuts against the periphery of the groove 23.

Figure 8:
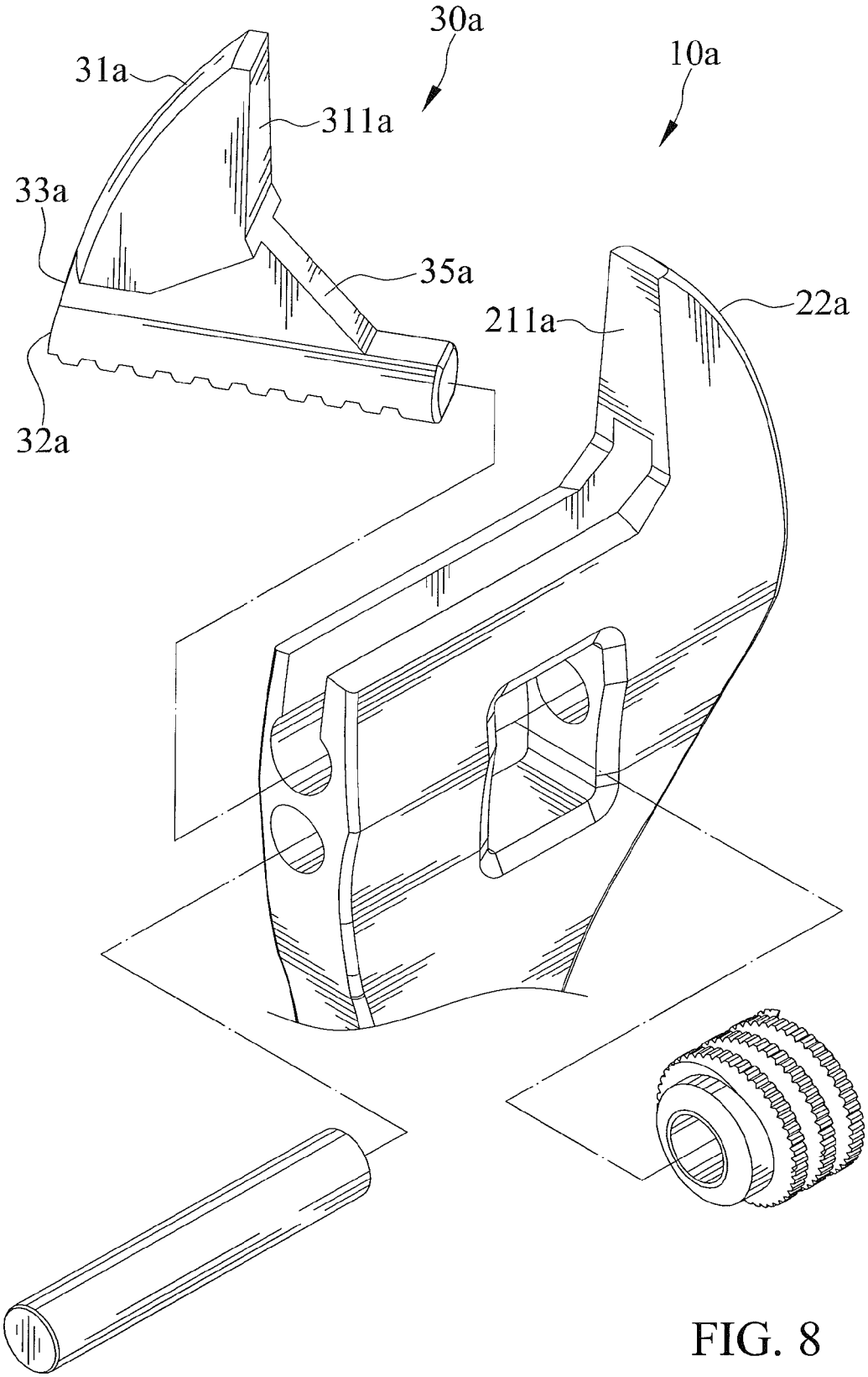
FIG. 8 is an exploded perspective view of an adjustable wrench with a strength enhancing structural design in accordance with a second embodiment of the present invention.
Figure 9:
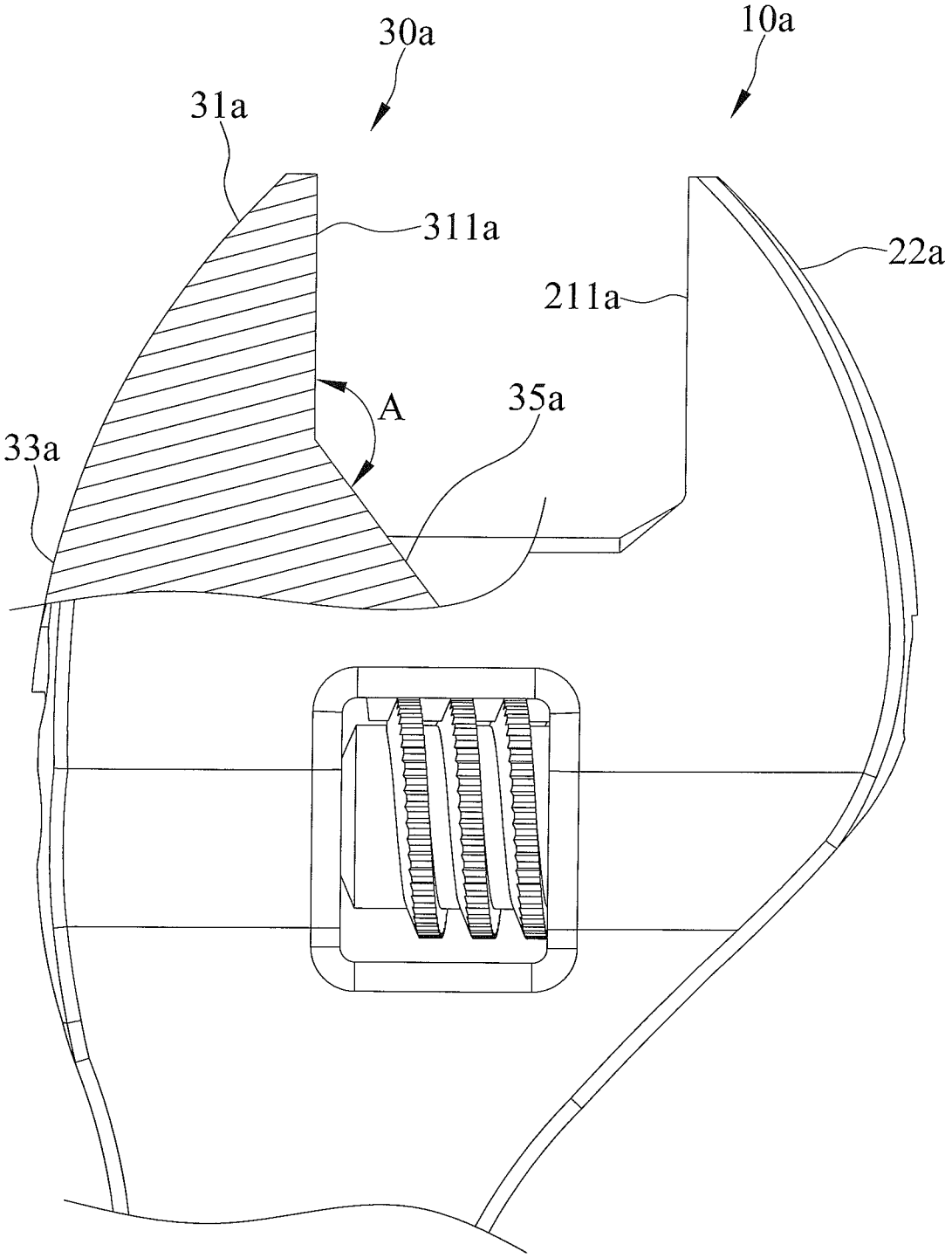
FIG. 9 is a partial, cross-sectional view of the adjustable wrench of FIG. 8.

FIGS. 8 and 9 show an adjustable wrench 10 with a strength enhancing structural design in accordance with a second embodiment of the present invention. The second embodiment is similar to the first embodiment, and the same numbers are used to correlate similar components of the first embodiment, but bearing a letter a. The second embodiment differentiates from the first embodiment in that a movable jaw 30*a*, having a holding end 31*a* and moveable with respect to a fixed jaw 22*a*, has a first reinforced area 35*a* extending from a second holding surface 311*a* to a base 32*a* of the movable jaw 30*a* and forming a protrusion from the second holding surface 311*a* and a neck 33*a*. Furthermore, the second holding surface 311*a* and a surface of the protrusion are connected together and has a common edge, and a corner angle A between the holding surface 311*a* and the surface of the protrusion has a range between 120 and 150 degrees. Preferably, the corner angle A has a range between 140 and 150 degrees. In addition, a common edge between the holding end 31 and the neck 33 extends at heights between a height of an end of the first reinforced area 35*a* that joins the second holding surface 311*a* and a height of another end of the first reinforced area 35*a* that joins the base 32*a*. The fixed jaw 22*a* defines a first holding surface 211*a*.

In view of the forgoing, the first included angle θ1 of the first and second surfaces 251 and 252 of each of the two lateral walls 25 of the groove 23 is acute, and the movable jaws 30 and 30*a* include the sloped surfaces 312 corresponding to and abutting against the second surfaces 252 of the two lateral walls 25 when the adjustable wrenches 10 and 10*a* are driving an object 90 and when the lateral walls 25 are subject to elastic deformation. Furthermore, the bases 32 and 32*a* of the movable jaws 30 and 30*a* abut against the periphery of the groove 23 when the adjustable wrenches 10 and 10*a* are driving the object 90 and when the lateral walls 25 are subject to elastic deformation. Therefore, the movable jaws 30 and 30*a* will not move relative to the fixed jaws 22 inadvertently when the adjustable wrenches 10 and 10*a* are driving the object.

While the specific embodiments have been illustrated and described, numerous modifications come to mind without significantly departing from the spirit of invention, and the scope of invention is only limited by the scope of the accompanying claims.

What is claimed is:

1. An adjustable wrench with a strength enhancing structural design comprising:

a body including a grip end a user grasps when operating at a first end thereof and a driving head at a second end thereof, with the driving head including a fixed jaw; and a movable jaw for clamping an object to be driven with the movable jaw including a holding end, a base, and a neck extending between the holding end and the base, with the holding end including two sloped surfaces, with the neck and the base of the moveable jaw engaging and operably movable in a groove formed in the body, wherein the holding end is disposed outside the groove, with the groove including two lateral walls facing oppositely and spaced from each other, with each of the two lateral walls including a first surface and a second surface, with the first surfaces of the two lateral walls facing oppositely and separated by a space, with the first and second surfaces of each of the two lateral walls having a common edge and a first included angle less than 90 degrees, with the two sloped surfaces corresponding to and abutting against the second surfaces of the two lateral walls, with the groove further defining a receiving area including an inner periphery connected between the first surfaces of the two lateral walls opposite to the second surfaces, wherein the base of the movable jaw is received in the receiving area of the groove, does not abut against the inner periphery of the groove and does not contact the inner periphery of the groove when the movable jaw is in a neutral position thereof, and wherein the base of the movable jaw received in the receiving area of the groove abuts against the inner periphery of the groove when the adjustable wrench is driving the object and when the two lateral walls are subject to elastic deformation.

2. The adjustable wrench with the strength enhancing structural design as claimed in claim 1, wherein an imaginary plane of symmetry extends between the two lateral walls and through the driving head and the grip end, wherein a first width measures the second surface of each of the two lateral walls in a direction perpendicular to the imaginary plane of symmetry, wherein a second width measures the neck in a direction perpendicular to the imaginary plane of symmetry, and wherein a ratio of the first width to the second width has a range between 0.5 and 1.

3. The adjustable wrench with the strength enhancing structural design as claimed in claim 2, wherein the ratio of the first width to the second width has a range between 0.7 and 0.89.

4. The adjustable wrench with the strength enhancing structural design as claimed in claim 3, wherein the ratio of the first width to the second width is 0.75.

5. The adjustable wrench with the strength enhancing structural design as claimed in claim 2, wherein a first imaginary line extends through a center of the receiving area, wherein the receiving area has a first diameter, wherein a second imaginary line extends through a center of the base, and wherein the base has a second diameter less than the first diameter.

6. The adjustable wrench with the strength enhancing structural design as claimed in claim 5, wherein the fixed jaw defines a first holding surface, wherein the movable jaw defines a second holding surface facing oppositely and corresponding to the first holding surface, wherein the movable jaw includes the second holding surface extending on the holding end thereof, wherein the movable jaw has a first reinforced area extending from the second holding surface to the base of the movable jaw and forming a protrusion from the second holding surface and the neck, wherein the second holding surface and a surface of the protrusion are connected together and has a common edge, and wherein a corner angle between the holding surface and the surface of the protrusion has a range between 120 and 150 degrees.

7. The adjustable wrench with the strength enhancing structural design as claimed in claim 6, wherein the corner angle has a range between 140 and 150 degrees.

8. The adjustable wrench with the strength enhancing structural design as claimed in claim 5, wherein the first diameter is greater than the second width.

9. The adjustable wrench with the strength enhancing structural design as claimed in claim 2, wherein a reinforced region is formed in each of two opposite sides of the driving head and forms a ridge, wherein an imaginary line extends through a peak of the ridge on each of the two opposite sides in a direction perpendicular to the imaginary plane of symmetry, wherein the imaginary line is not interfered with the groove, wherein a distance from the peak of the ridge on one of the two opposite sides to the peak of the ridge on another of the two opposite sides is greater than a distance from the second surface of one of the two lateral walls connecting to one of two sides to the second surface of another of the two lateral walls connecting to another of the two sides.

10. The adjustable wrench with the strength enhancing structural design as claimed in claim 1, wherein the first included angle is 70 degrees.

11. The adjustable wrench with the strength enhancing structural design as claimed in claim 2, wherein the neck has two opposite lateral sides each facing the first surface of each of the two lateral walls, wherein each of the two opposite lateral sides and the second surface of each of the two lateral walls disposed on a same side of the imaginary plane of symmetry include a second included angle having a range between 50 and 90 degrees.

12. The adjustable wrench with the strength enhancing structural design as claimed in claim 11, wherein the first and second included angles are equal.

13. The adjustable wrench with the strength enhancing structural design as claimed in claim 1, wherein the movable jaw includes a toothed section engaging with a worm, wherein the worm is mounted and rotatable on a fixing member, and wherein the movable jaw is moved with respect to the fixed jaw when the worm is operably rotated on the fixing member.

14. The adjustable wrench with the strength enhancing structural design as claimed in claim 1, wherein the inner periphery of the receiving area is arcuate from the first surface of one of the two lateral walls to the first surface of another of the two lateral walls.

* * * * *